US006283291B1

(12) United States Patent
Vasudeva et al.

(10) Patent No.: US 6,283,291 B1
(45) **Date of Patent: *Sep. 4, 2001**

(54) DRILL BIT CASE WITH PIVOTABLE HOLDERS

(75) Inventors: Kailash C. Vasudeva, Waterloo; Maz A. Hasan, Kitchener, both of (CA)

(73) Assignee: Maxtech Manufacturing Inc., Waterloo (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/317,129

(22) Filed: May 24, 1999

(51) Int. Cl.[7] ..... B65D 85/28

(52) U.S. Cl. ..... 206/373; 206/379; 206/747; 206/748; 211/69

(58) Field of Search ..... 206/747, 748, 206/39.4, 556, 761, 764, 379; 211/69

(56) References Cited

U.S. PATENT DOCUMENTS

| | | | | |
|---|---|---|---|---|
| 2,403,825 | | 7/1946 | Nissenbaum . | |
| 2,589,593 | | 3/1952 | Anderson et al. . | |
| 2,775,342 | | 12/1956 | Smith . | |
| 3,074,539 | | 1/1963 | Rogovin . | |
| 3,086,645 | | 4/1963 | Yount . | |
| 3,236,366 | * | 2/1966 | Broda et al. | 206/379 |
| 3,353,657 | | 11/1967 | Young . | |
| 3,578,153 | * | 5/1971 | Olson | 206/379 |
| 4,006,821 | | 2/1977 | Sautter . | |
| 4,091,918 | | 5/1978 | Soulakis et al. . | |
| 4,493,417 | | 1/1985 | Ackeret . | |
| 4,660,719 | * | 4/1987 | Peterson et al. | 206/379 |
| 4,880,122 | * | 11/1989 | Martindell | 211/70.6 |
| 5,497,875 | * | 3/1996 | Kuo | 206/751 |
| 5,533,625 | | 7/1996 | Mikkelsen . | |
| 5,676,254 | | 10/1997 | Cheng . | |
| 5,746,316 | | 5/1998 | La Barre . | |
| 5,878,882 | * | 3/1999 | Kohagura | 206/379 |
| 5,893,457 | * | 4/1999 | Wei | 206/373 |

* cited by examiner

*Primary Examiner*—Paul T. Sewell
*Assistant Examiner*—Troy Arnold
(74) *Attorney, Agent, or Firm*—R. Craig Armstrong

(57) ABSTRACT

The case for drill bits or the like provides automatic rotation a holder to an access position on opening the cover, without any linkage to the cover. The rotation may be by virtue of a molded or mechanical spring or other biasing means, such as springiness of a living hinge, for example. Each holder provides multiple holes into or through which drill bits or the like are inserted. The action of closing the cover moves the holders from their access position into a storage position, by contacting one or more of the holders, or one or more of the drill bits. The case can be a one-piece molded construction, or an assembly of various components, e.g. base, cover, holders, and removable stop walls. A locking bar may be provided to prevent removal of drill bits of the type having a recess in their shanks, and the locking bar may be movable between a locked and unlocked position, for example by closing or opening of the cover.

10 Claims, 20 Drawing Sheets

DRILL BIT CASE WITH PIVOTABLE HOLDERS

BACKGROUND OF THE INVENTION

This invention relates to a case for drill bits or the like, such as may be used to hold the drill bits or the like at the point of sale and/or subsequently as a storage holder.

The case could be used for similar items such as screwdriver bits, taps, router bits, and similar power tool accessories, etc. For convenience, "drill bits" will be referred to herein, or "items" generally. It should be understood that where "drill bits" are referred to expressly, that is as an example only, and is not intended to be limiting.

Many drill bit cases are presently on the market, and a number of them have manually rotatable holders in which the drill bits are carried. The holders typically are blocks or plates having a plurality of holes into or through which the drill bits may be positioned. Alternatively, the holders may be clips into which the drill bits snap. The cases commonly have a box-like base in which the holders are mounted, and a cover hinged to the base at a top, bottom or side edge. The holders rotate between a storage position wherein the holders and hence the drill bits are aligned or generally aligned with the main plane of the base, and an access position wherein the holders and hence the drill bits are angled outwardly from the main plane for easier access. By "main plane", what is meant is the plane to which most elements of the case are closest, i.e. normally a plane parallel to and generally midway between the front and back of the case.

In the prior art cases with rotatable holders, generally they must be rotated manually, or there is a linkage to the cover of the case which rotates them to the access position when the cover is opened. Manual operation is a nuisance; linkages add to the cost of the case, and can be temperamental.

SUMMARY OF THE INVENTION

In view of the preceding, it is an object of the invention to provide an improved case for drill bits, offering automatic rotation of the drill bit holders to the access position on opening the cover, without any linkage to the cover.

The case has at least one and possibly several holders rotatably mounted in a base portion thereof, for rotation between a storage position and an access position. Each holder provides multiple holes into or through which drill bits are inserted.

As in the prior art, in the access position the holders are oriented at an angle to the main plane of the base, such that the drill bits angle outwardly from the base for easier access. In the storage position, each holder is more aligned with the main plane of the base, for example oriented parallel or close to parallel to the main plane.

Not all holders necessarily rotate automatically. For example, there could be a front holder which is rotatable on opening the cover, and a rear holder which is not rotatable at all, or which is only manually rotatable.

Any holders which are in the access position must be rotated to their storage positions in order for the cover to close. Although they could be rotated manually to their storage positions, preferably the action of closing the cover moves them to the storage position, by contacting one or more of the holders, or one or more of the drill bits.

The holders rotate to the access position automatically upon opening of the cover, by virtue of a molded or mechanical spring or other biasing means, such as springiness of a living hinge, for example.

The case can be a one-piece molded construction, or an assembly of various components, e.g. base, cover, holders, and removable stop walls.

Further features of the invention will be described or will become apparent in the following detailed description.

BRIEF DESCRIPTION OF THE DRAWINGS

The invention will now be described in detail with reference to the accompanying drawings, in which.

DETAILED DESCRIPTION OF THE PREFERRED EMBODIMENTS

Figure 1:
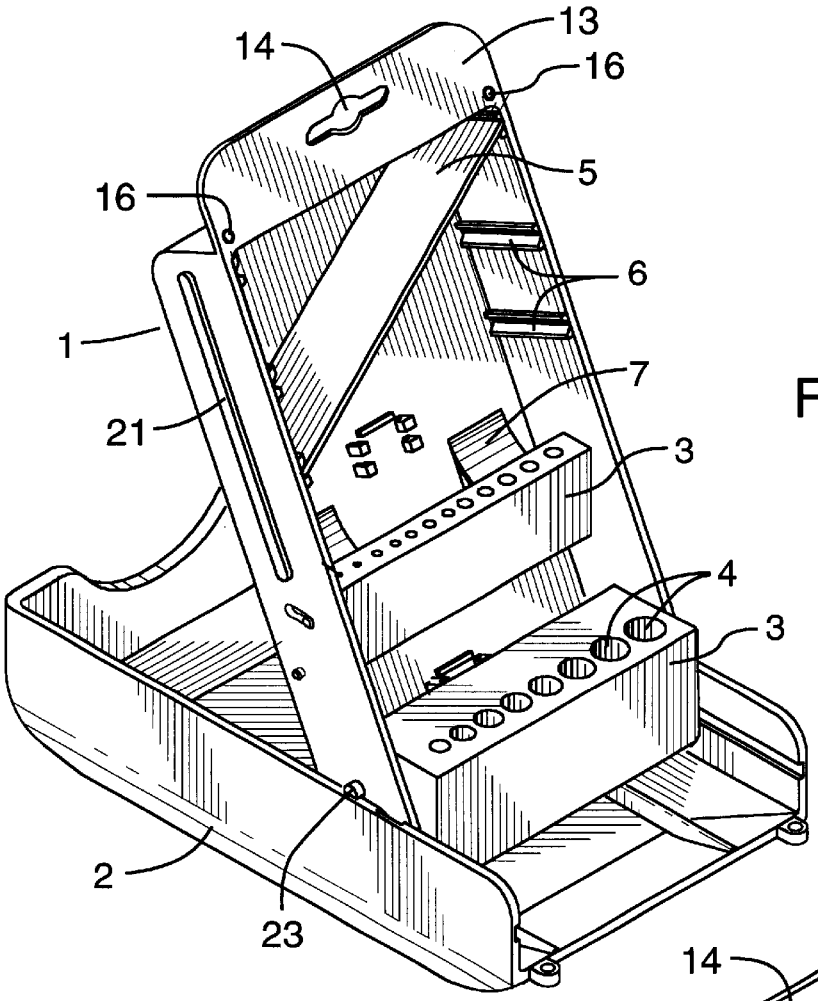
FIG. 1 is a perspective view of a preferred embodiment of the case, with the cover open and the drill bit holders in their access position.
Figure 2:
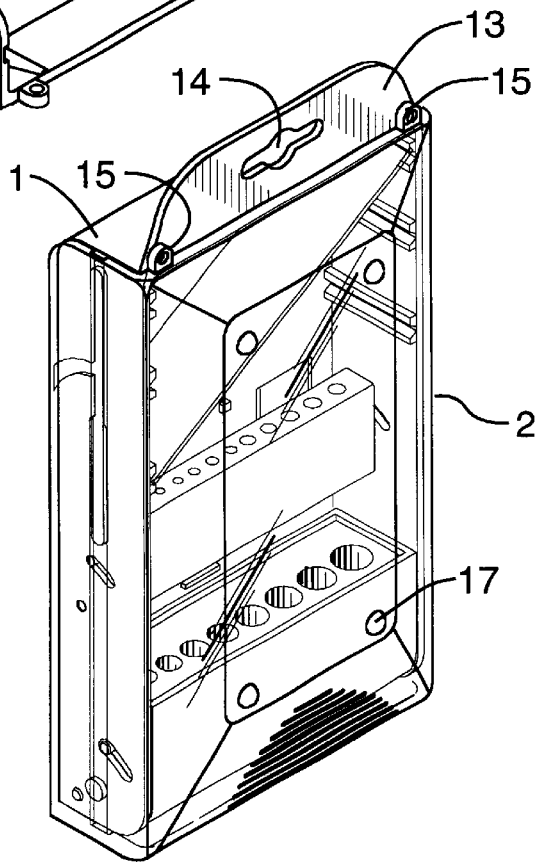
FIG. 2 is a perspective view of the preferred embodiment, closed.

FIGS. 1–11 illustrate the preferred embodiment. FIG. 1 is a perspective view showing the main box-like portion or "base" 1, cover 2 fully open, and two drill bit holders 3 in their access position, with holes 4 to receive drill bits 99 (seen in FIGS. 6–11). FIG. 2 shows the same case, fully closed. The cover preferably is transparent, as illustrated in FIG. 2, but obviously could be translucent or opaque.

Figure 3:
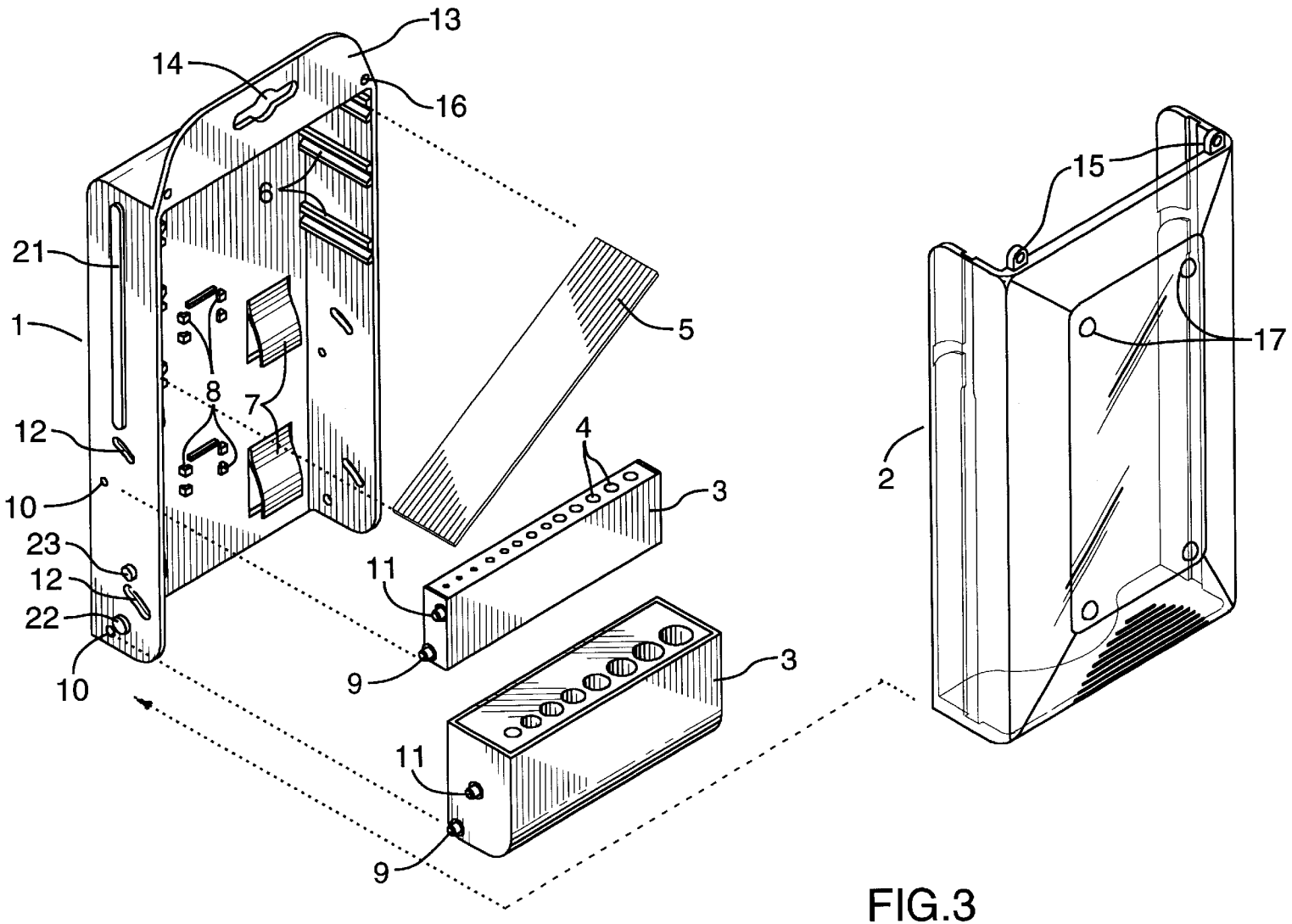
FIG. 3 is an exploded perspective of the preferred embodiment.

The various components are best seen in the exploded perspective of FIG. 3, and in addition to the items mentioned in the preceding paragraph, include a removable stop plate 5 to prevent drill bits from coming out of their holders when the holders are in their storage positions. The case preferably is provided with several tracks 6 along each side, the stop plate being fitted into one on each side. Having several provides the manufacturer with several positioning options, for different drill bit combinations, without having to have a separate mold or separate production runs. Alternatively, the stop plate could be a permanent, integral part of the base, or it could be omitted entirely if desired.

The base also includes at least one integral living spring 7 for each holder 3, to bias the holders to their access positions when the case is open. As an alternative to the living springs, a metal leaf spring (not shown) could be mounted in the spring mounts 8 which are preferably provided in the base to allow this alternative.

As can be seen best in FIG. 3, the holders have pivot pins 9 at either end, which fit into corresponding pivot holes 10 in the base. The holders also have stop pins 11 which fit into curved slots 12 in the base, to limit the rotation of the holders.

Preferably, the base includes an upward extension 13 with an opening 14 for hanging the case on a point-of-sale display rack or subsequently on the purchaser's tool rack.

Preferably, the cover has apertured projections 15 which align with holes 16 in the extension 13, so that plastic locking loops (not shown) may be installed to prevent opening the case at the point of sale.

Figure 4:
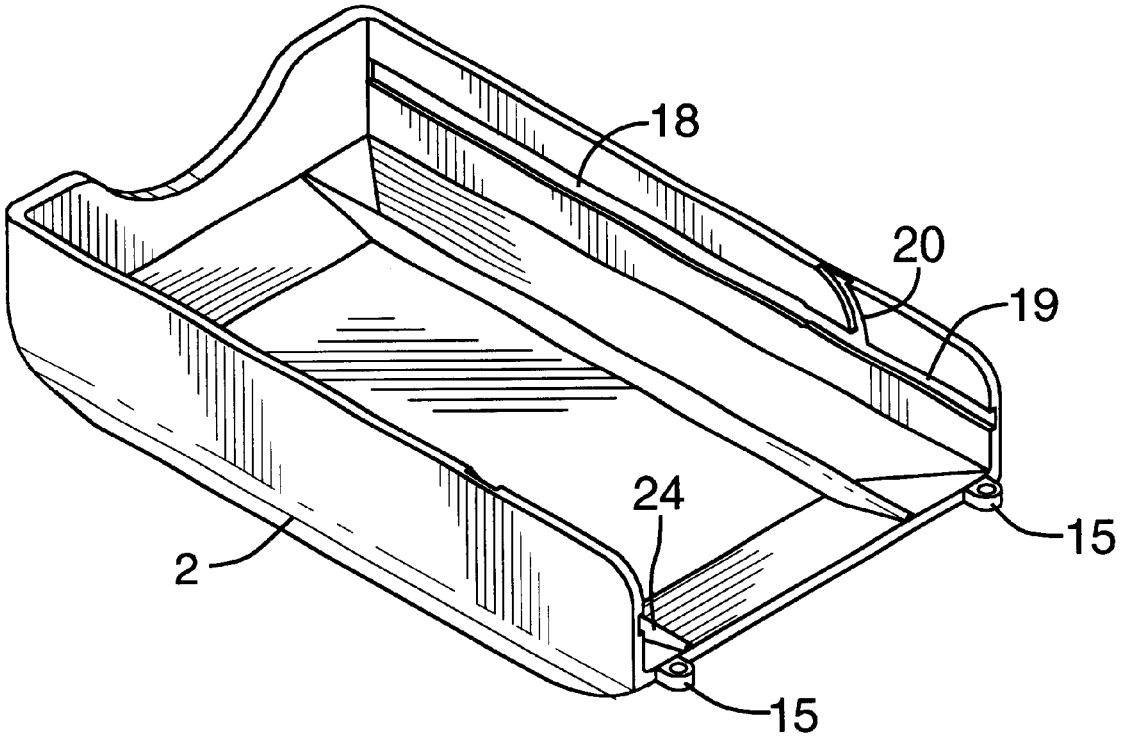
FIG. 4 is a perspective view of the cover in the preferred embodiment.
Figure 5:
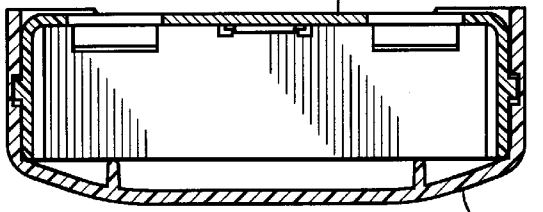
FIG. 5 is an end cross-sectional view of the preferred embodiment.

FIG. 4 is a perspective view of the cover 2. FIG. 5 is an end crosssectional view of the closed case.

Figure 6:
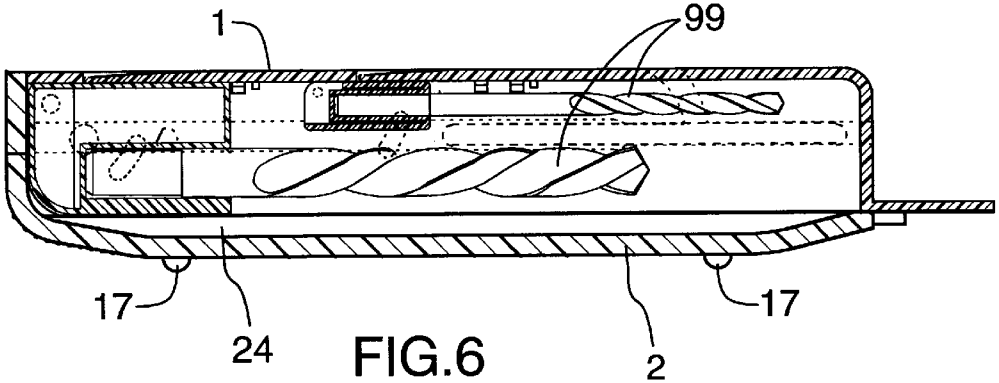
FIG. 6 is a side cross-sectional view of the preferred embodiment, closed.

FIGS. 6–11 show the operation of the case. In FIG. 6, the case is fully closed, and placed with the cover down. Support bosses 17 preferably are provided on the outside of the cover, so that the cover rests on them and does not become too scratched in use. As can be seen clearly in FIG. 5, the base is positioned within the cover in such a way that it can slide along within the cover from the position shown in FIG. 6 to the position shown in FIG. 7. As seen in FIG. 4, the cover has a track with a wide portion 18 and a narrow portion 19, and a curved groove 20 curving upwardly from the track. The base has a rail portion 21 running along the outside thereof, and a large pin 22 and small pin 23 projecting outwardly. The rail portion 21 slides within the track as the base moves to the FIG. 7 position. At that point, the large pin 22 stops the sliding, because it is larger in diameter than the width of the narrow portion 19 of the track. At that point, the small pin 23 is aligned with the curved groove 20.

Figure 7:
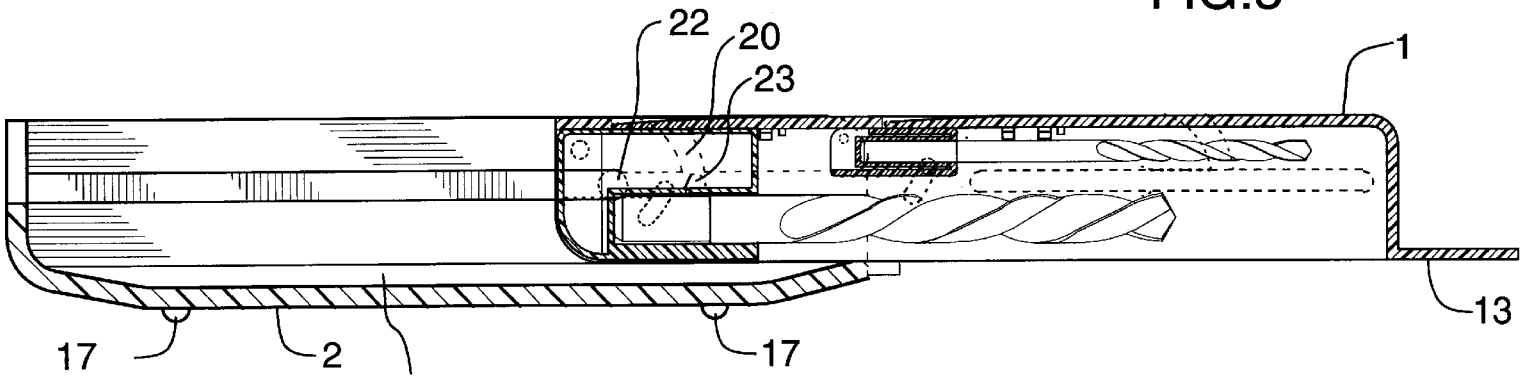
FIG. 7 is a side cross-sectional view of the preferred embodiment, with the cover moved towards the open position.
Figure 8:
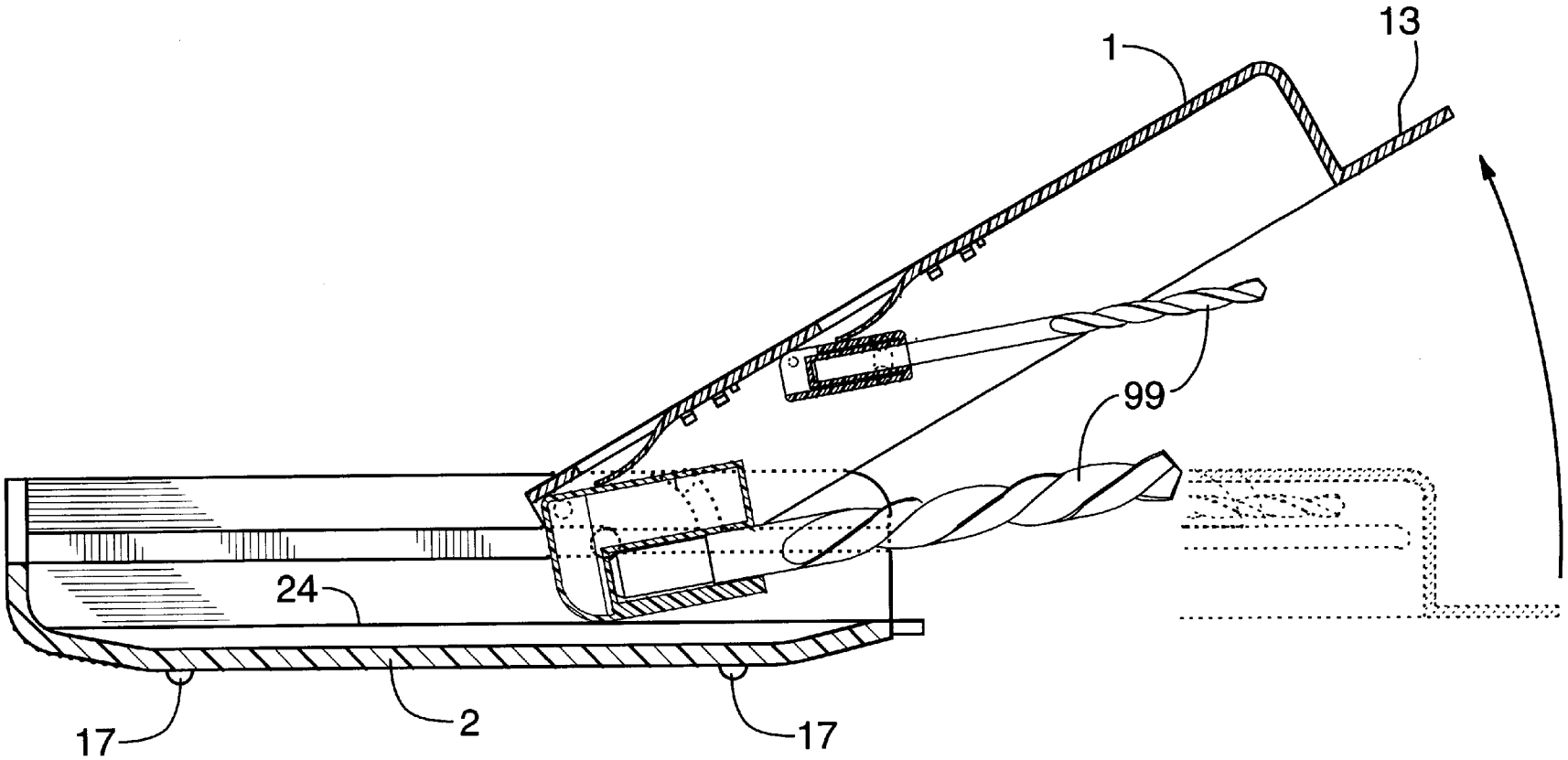
FIG. 8 is a side cross-sectional view of the preferred embodiment, with the base being pivoted away from the cover.
Figure 9:
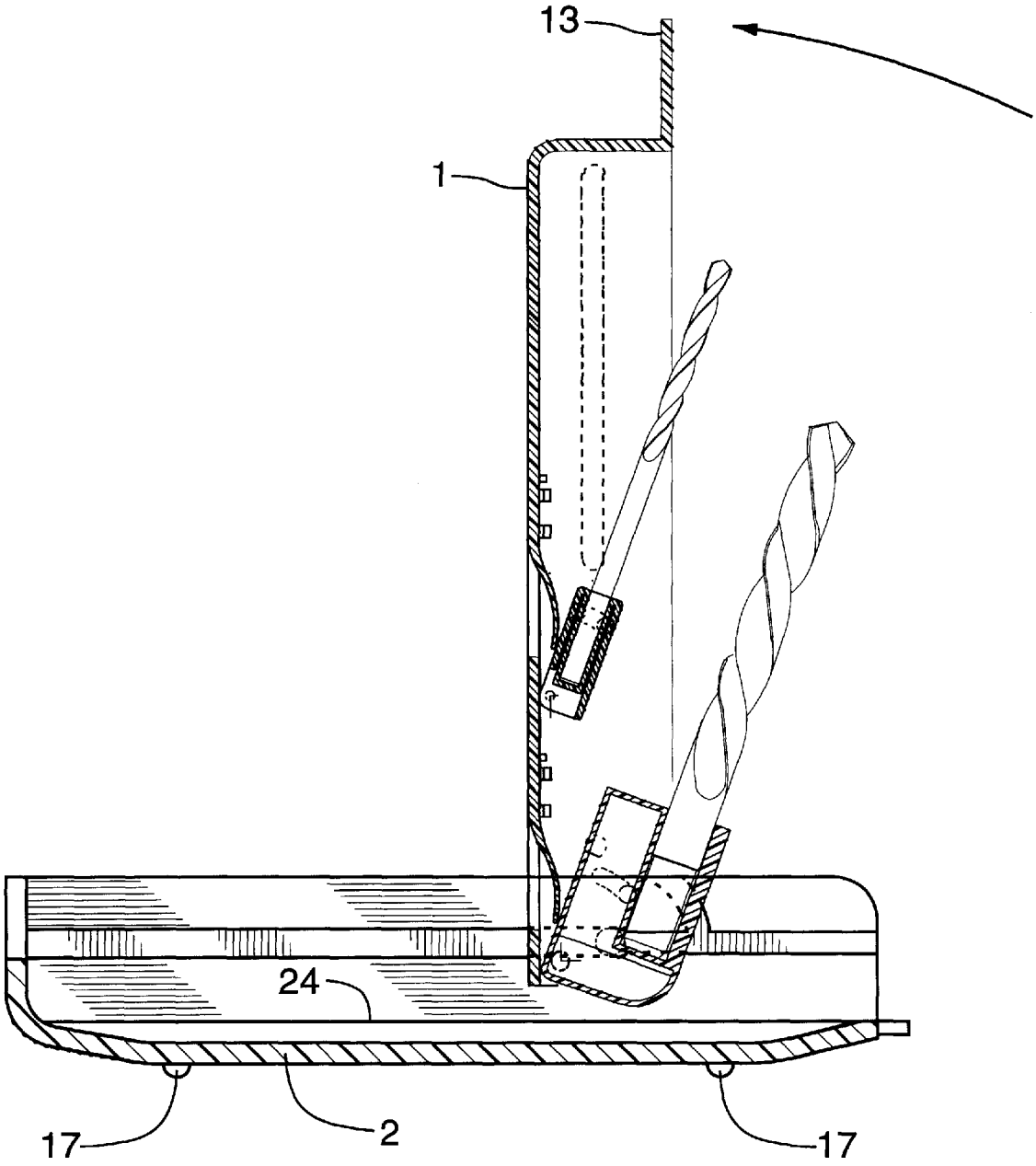
FIG. 9 is a side cross-sectional view of the preferred embodiment, with the base further pivoted away from the cover.
Figure 11:
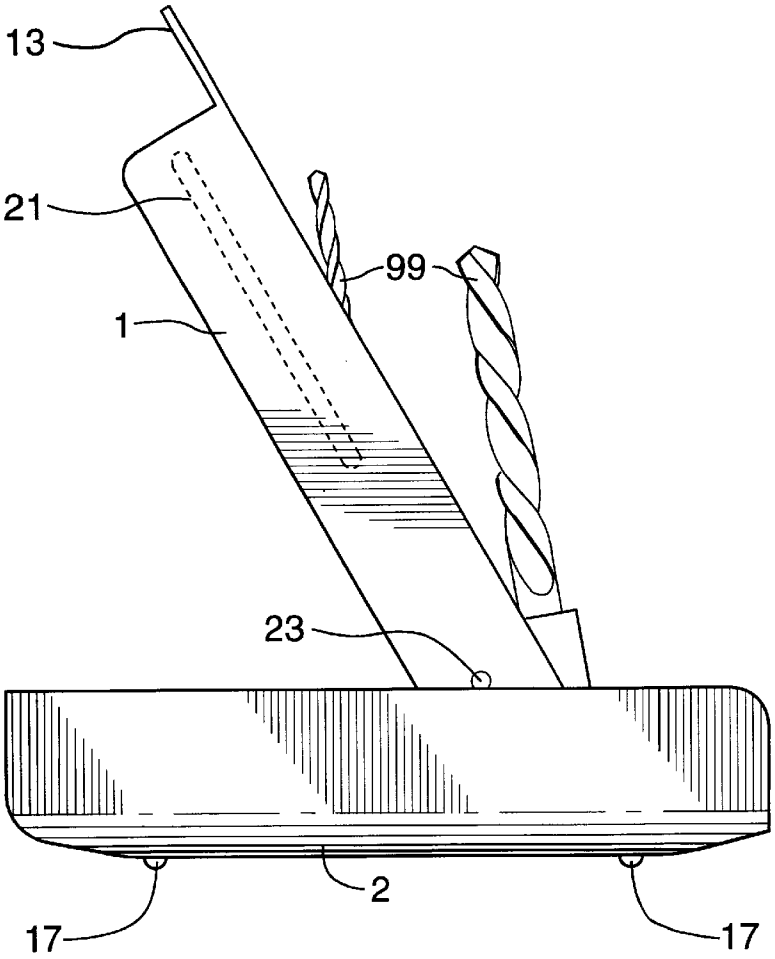
FIG. 11 is a side view of the preferred embodiment, fully open, corresponding to FIG. 10.
Figure 10:
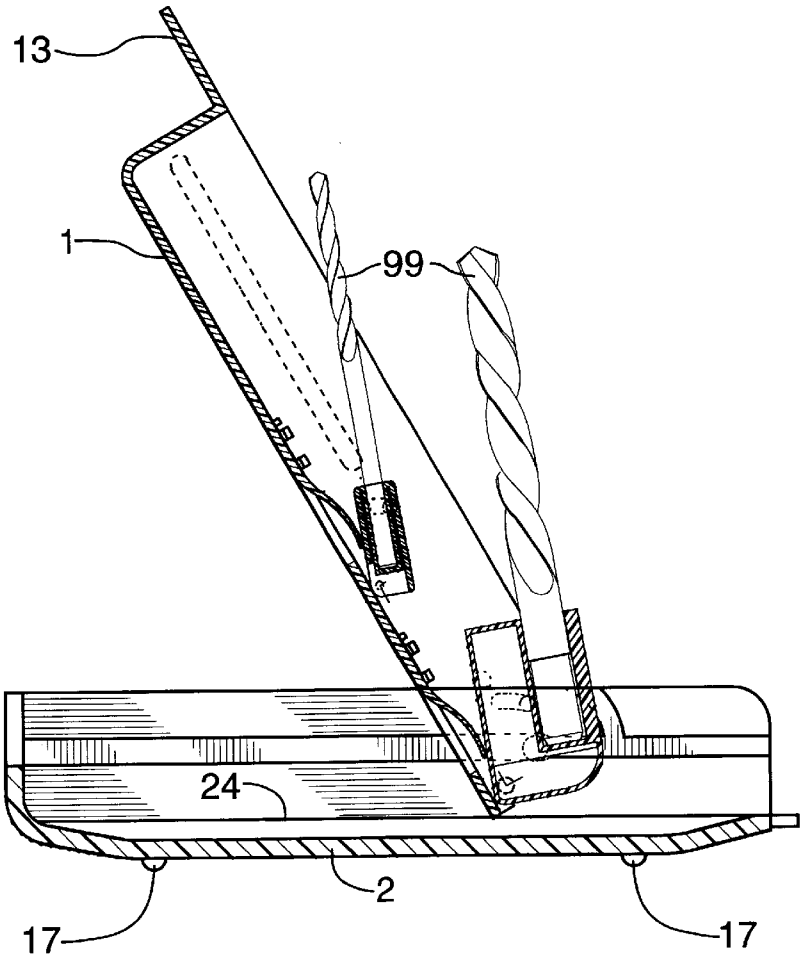
FIG. 10 is a side cross-sectional view of the preferred embodiment, fully open.
Figure 12:
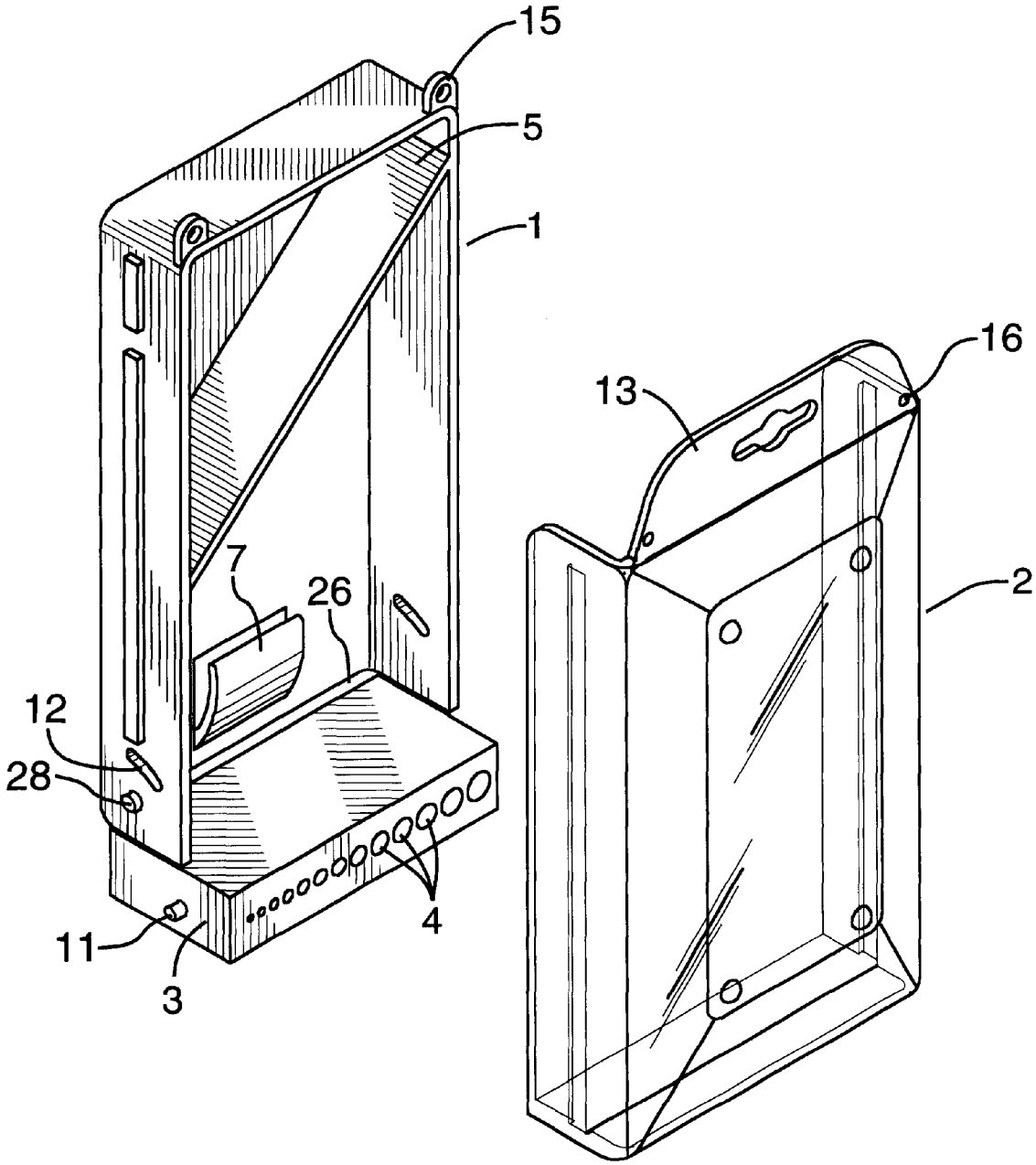
FIG. 12 is an exploded perspective view of a first alternative embodiment, in which a drill bit holder is integral with the base, connected thereto via a living hinge.

In moving from the FIG. 7 position through the FIG. 8 and FIG. 9 positions to the FIG. 10 fully open position, the base pivots about the large pin 22, and the small pin 23 travels up and through the curved groove 20. Eventually, as seen in FIG. 11, the small pin 23 comes into contact with edge of the cover, preventing further rotation, and supporting the base in the somewhat reclined position shown in FIGS. 10 and 11, for optimum convenience of access. Preferably, but not necessarily, the small pin has a flattened portion, to provide a flat surface to rest against the edge.

The cover preferably has several ribs 24 running longitudinally along the inside of the cover. As soon as the ribs no longer prevent rotation of the holders, the springs 7 move the holders to their access positions, the stop pins 11 then moving into contact with the end of their slots 12.

In the preferred embodiment, the cover has the tracks and slots and the base has the rail and pins. Alternatively, however, it should be clear that the cover could have the rail and pins, and the base could have the track and slots.

The preferred embodiment has two holders 3, but obviously the invention could be configured to have only one holder, or theoretically three or more holders, with obvious loss of practicality at a certain point.

As the base is rotated back into alignment with the cover, then the ribs 24 come into contact with the holders 3, to rotate them back into their storage positions.

FIGS. 12–18 illustrate a first alternative embodiment, in which the base and a holder are integrally molded, with a single holder 3 being connected to the base 1 via a living hinge 26. The overall structure and principal of operation is very similar. The living hinge may have inherent springiness, so that it acts as the biasing means to bias the holder towards the access position, or there may be an integral spring 7 as in the preferred embodiment, or a separate mechanical spring as discussed above (not shown).

In this embodiment, the holder also has stop pins 11 which fit into curved slots 12 in the base.

This embodiment provides an example of several other variations, for example there being only one holder 3, the stop plate 5 being fixed in place, and the extension 13 being part of the cover instead of part of the base, and the positions of the apertured projections 15 and holes 16 being reversed accordingly.

Figure 13:
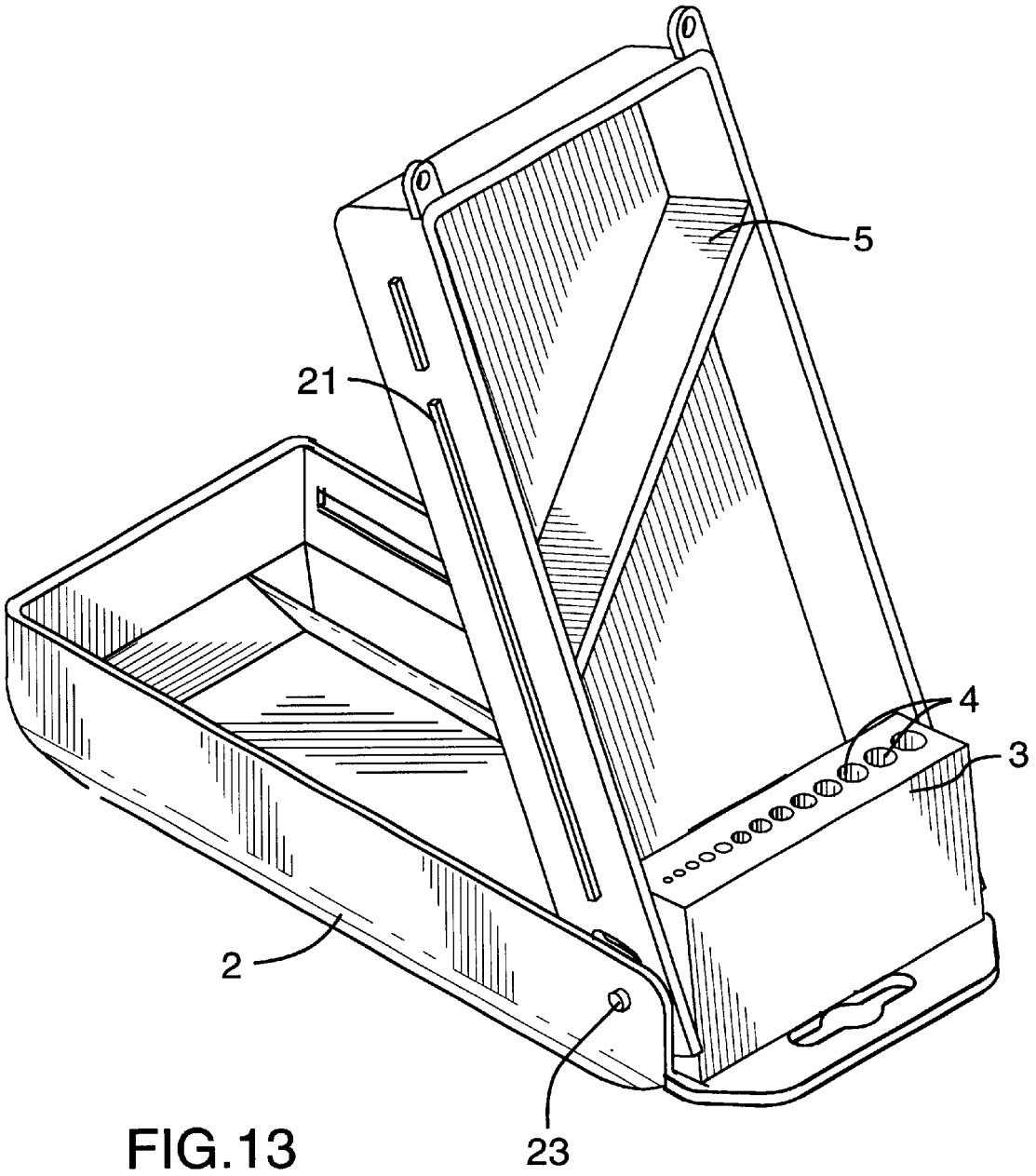
FIG. 13 is a perspective view of the first alternative embodiment, assembled and fully open.
Figure 14:
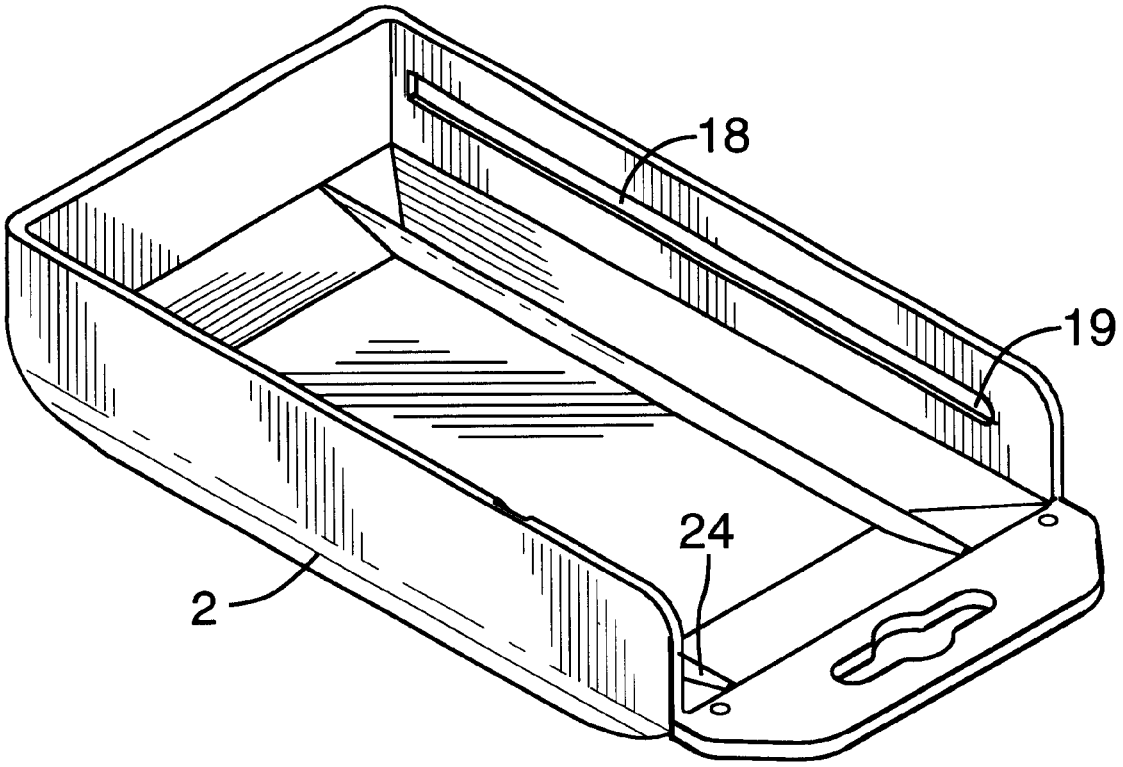
FIG. 14 is a perspective view of the cover of the first alternative embodiment.
Figure 16:
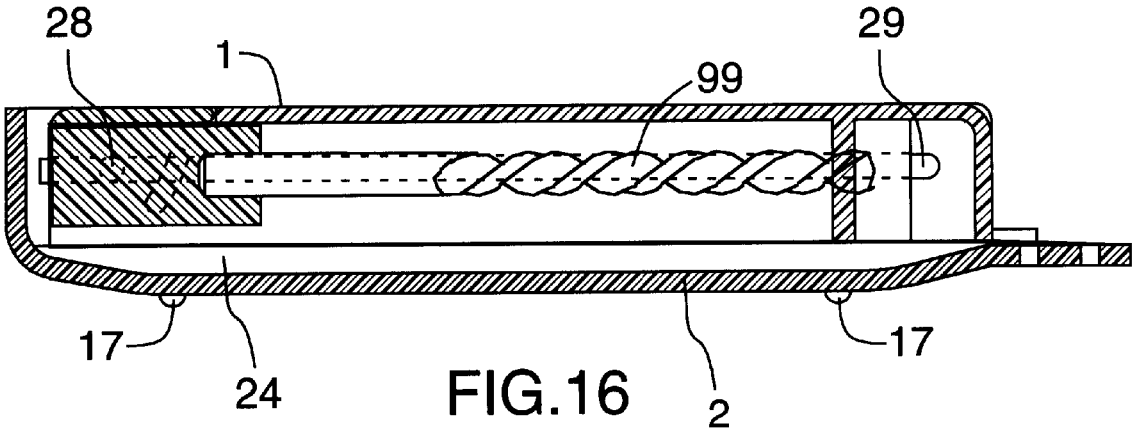
FIG. 16 is a side cross-sectional view of the first alternative embodiment, closed.
Figure 15:
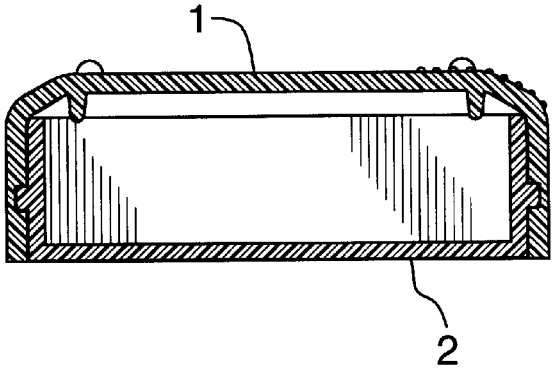
FIG. 15 is an end cross-sectional view of the first alternative embodiment.
Figure 17:
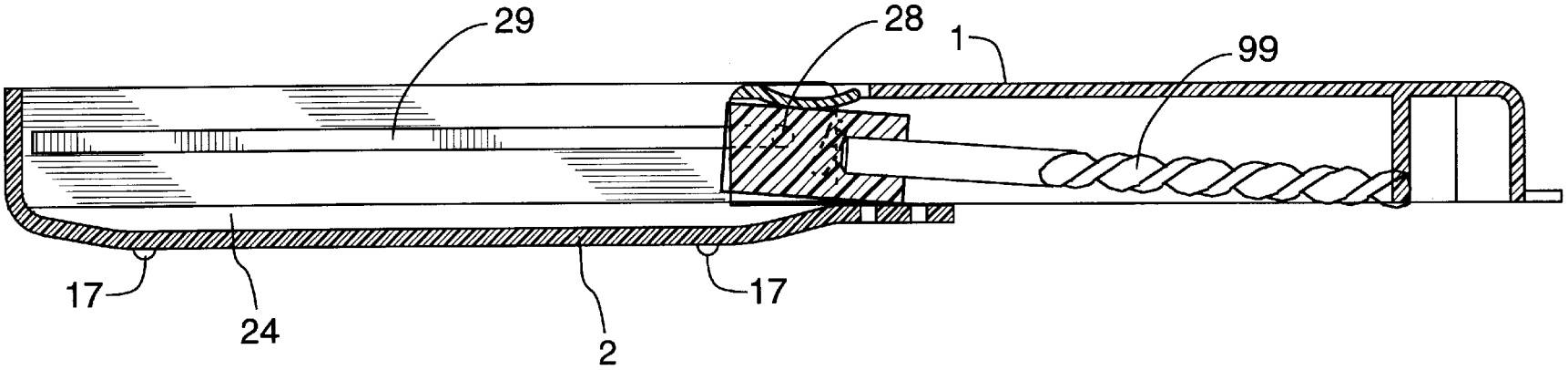
FIG. 17 is a side cross-sectional view of the first alternative embodiment, with the cover moved towards the open position.
Figure 18:
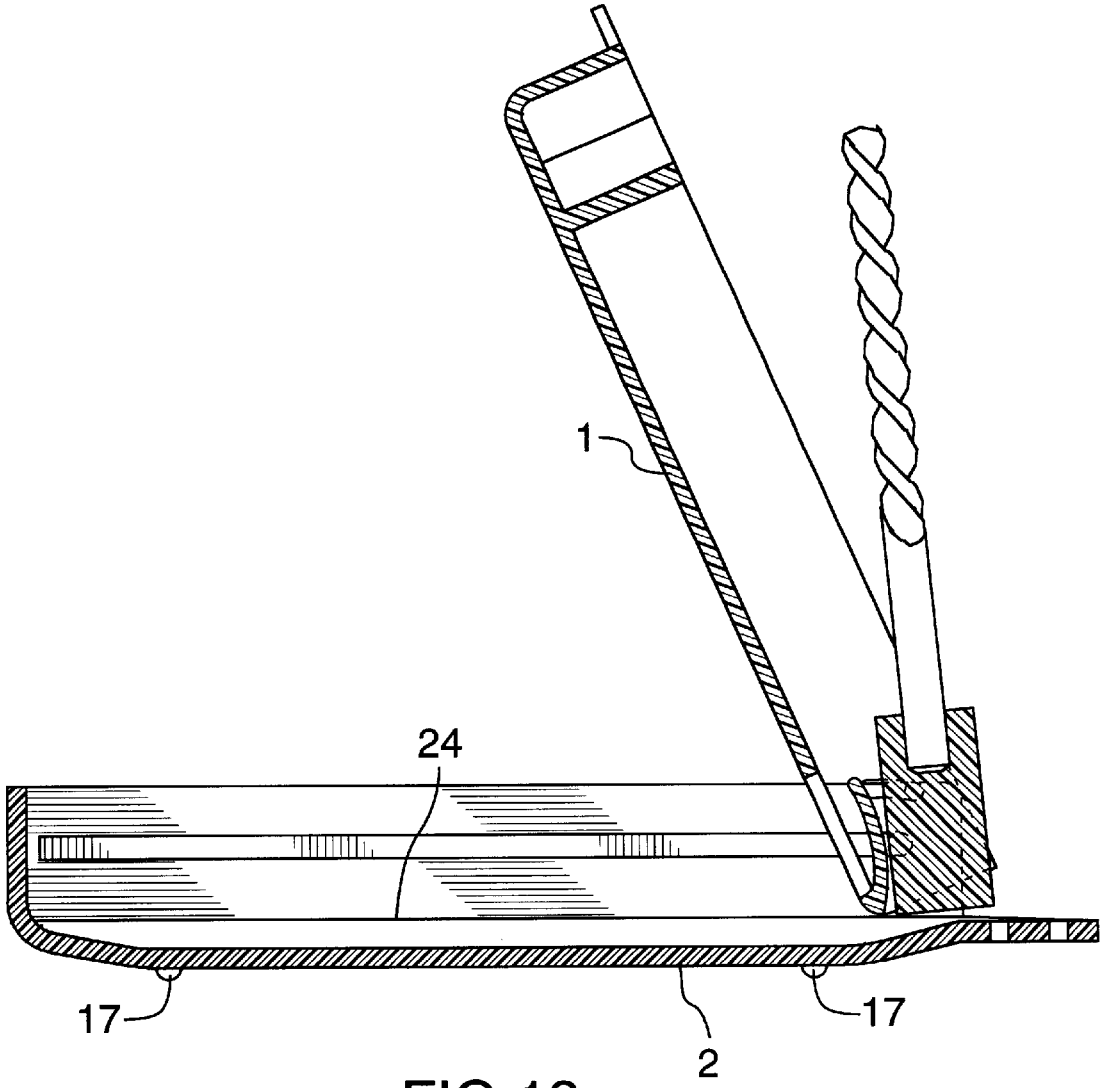
FIG. 18 is a side cross-sectional view of the first alternative embodiment, fully open.

FIG. 13 is shows the case fully open, and FIG. 14 shows just the cover. Some of the details of how the base rotates relative to the cover are different from the preferred embodiment. FIGS. 16–18 show the sequence. The base has a single pin 28 which slides in the track 29. A rail 21 as in the preferred embodiment prevents rotation of the base until the rail clears the track. Then the base can be rotated to the FIG. 18 position, where further rotation is prevented by the lower edge of the base resting against the ribs 24.

Figure 19:
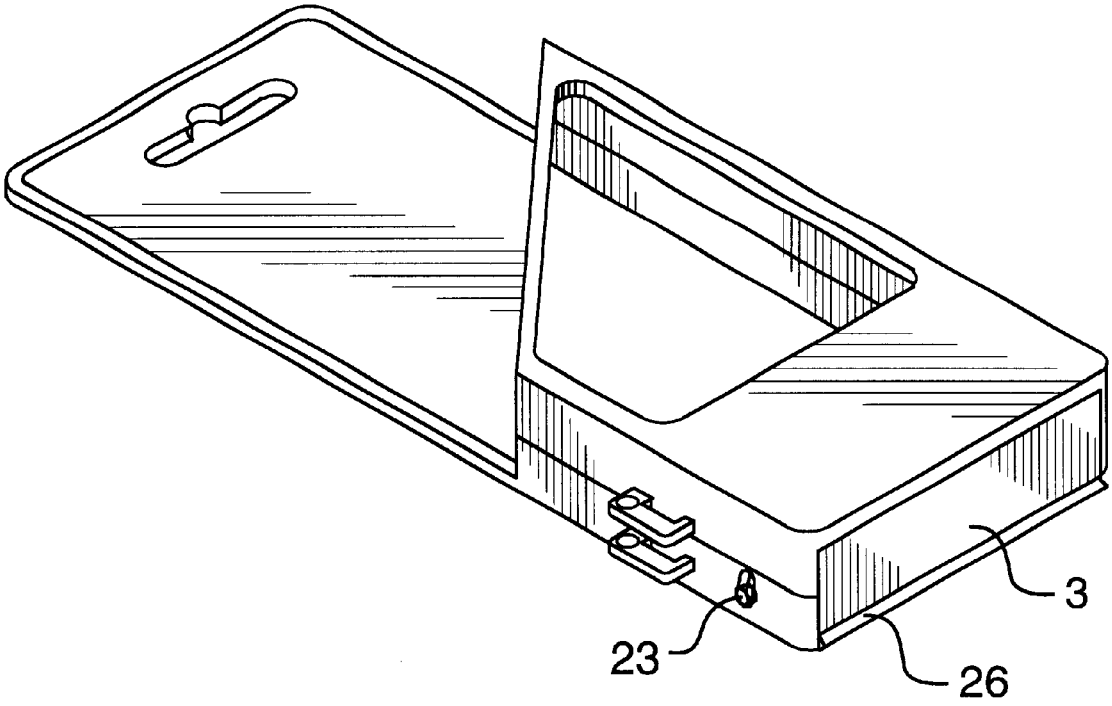
FIG. 19 is a perspective view of a second alternative embodiment, closed, this embodiment having the cover and holder integral with the base and connected to the base by respective living hinges.
Figure 20:
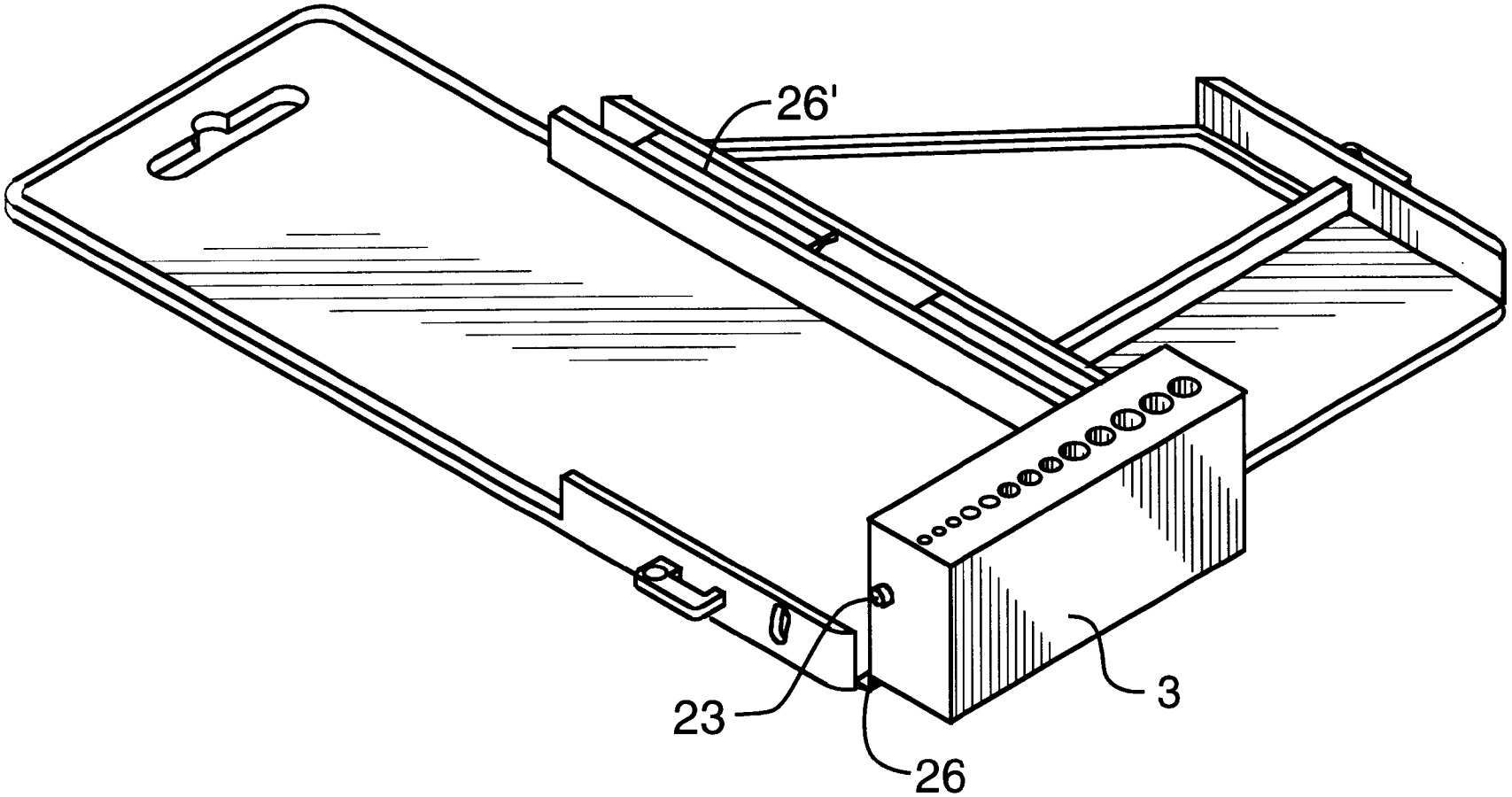
FIG. 20 is a perspective view of the second alternative embodiment, fully open, before proper positioning of the holder within the base.
Figure 21:
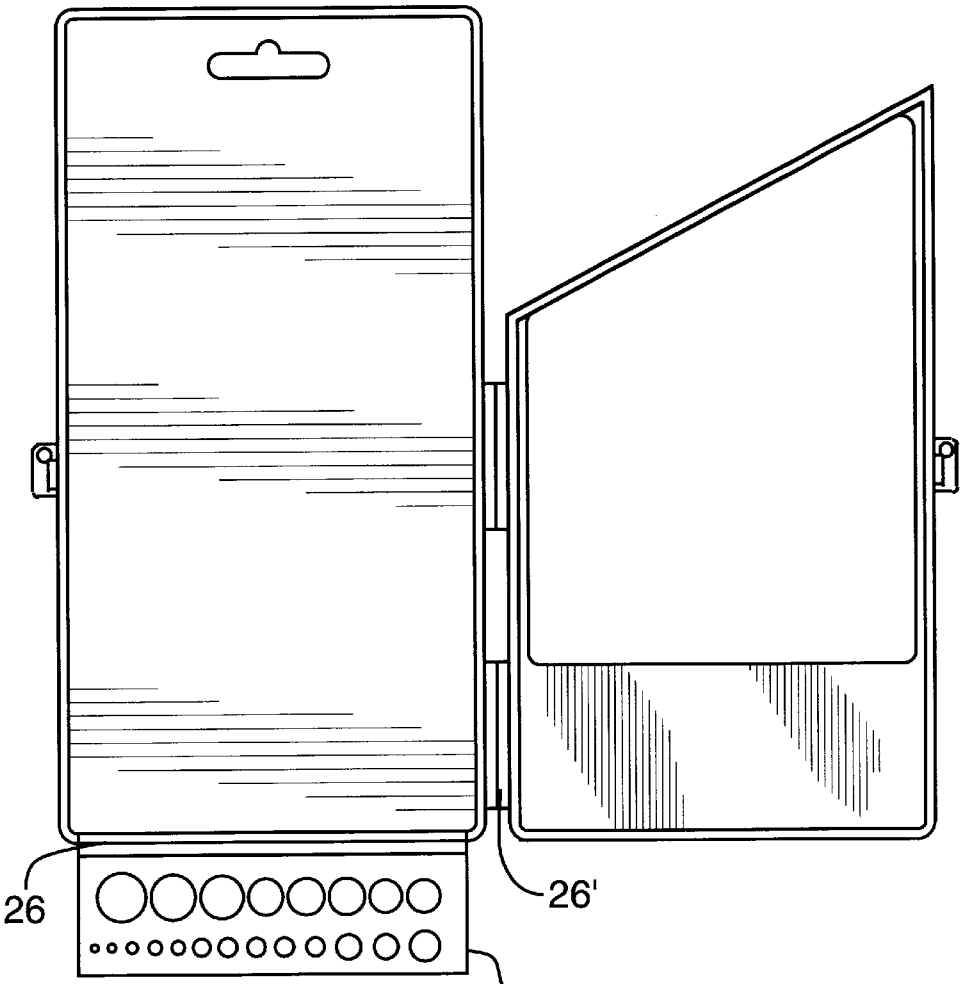
FIG. 21 is a plan view of the second alternative embodiment, showing a holder with two rows of openings for drill bits.

FIGS. 19–22 are various views of a second alternative embodiment, this embodiment having the holder and cover integral with the base and connected to the base by respective living hinges 26 and 26' (best seen in FIGS. 20–21). FIG. 19 is a perspective view of this embodiment, closed. FIG. 20 is a perspective view of this embodiment, fully open, before proper positioning of the holder within the base.

Figure 22:
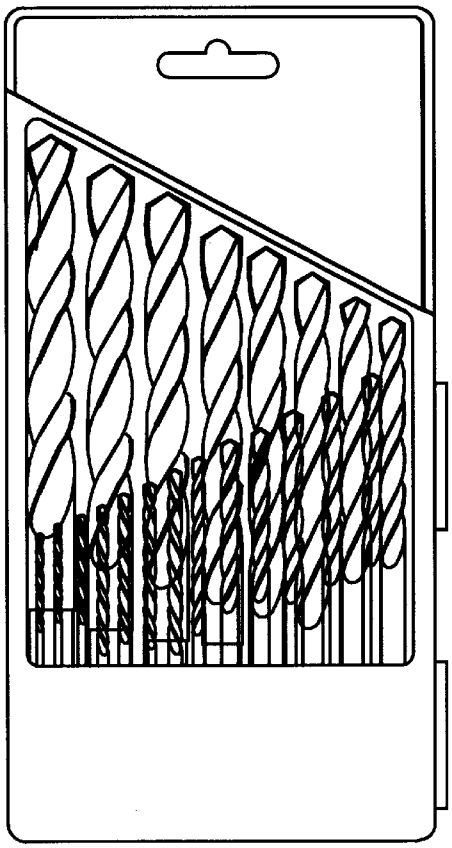
FIG. 22 shows the FIG. 21 embodiment closed and containing drill bits.

FIG. 21 is a plan view of the second alternative embodiment, showing a holder with two rows of openings for drill bits, and FIG. 22 shows the FIG. 21 embodiment closed and containing drill bits.

Figure 23:
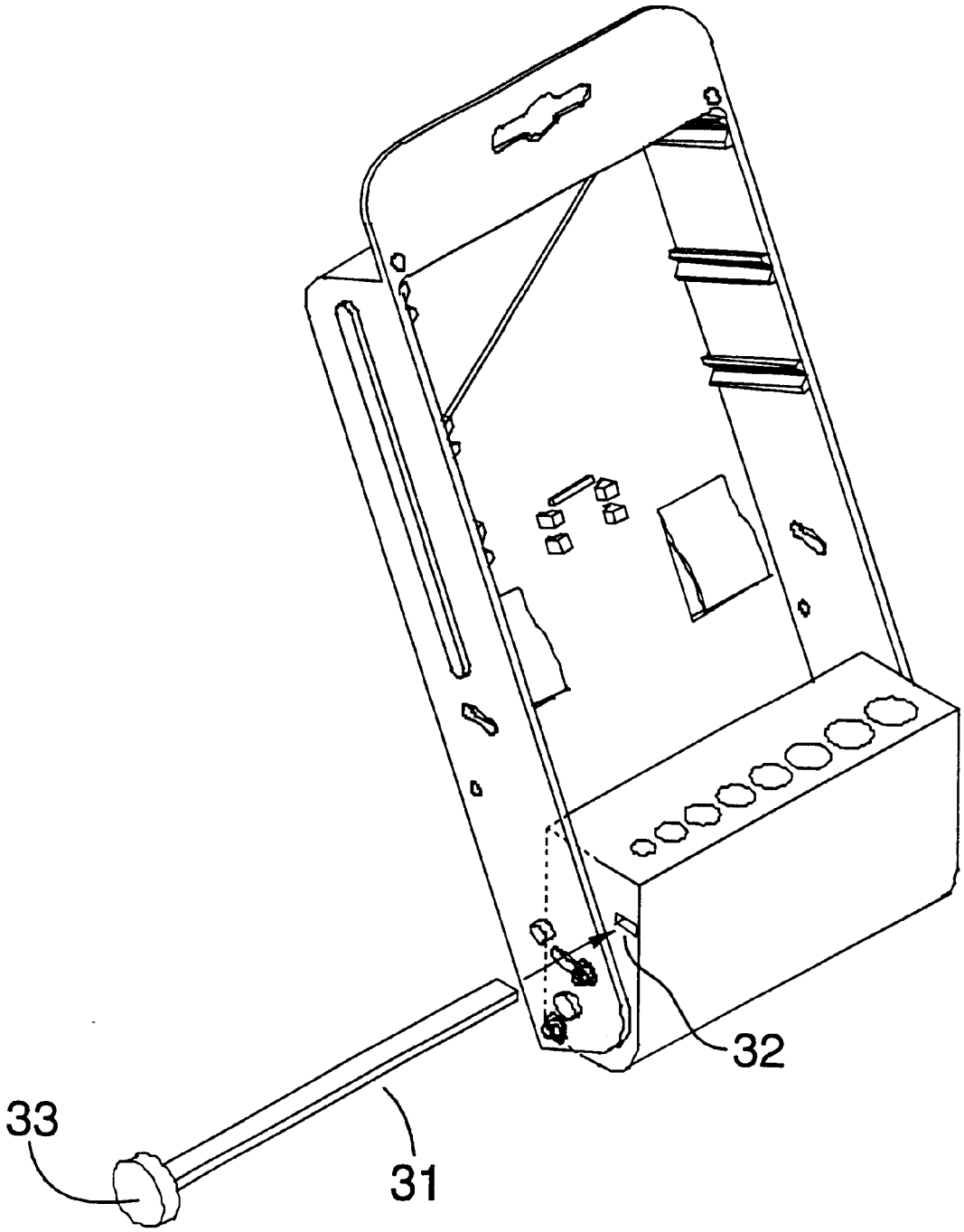
FIG. 23 is an exploded perspective view showing a locking bar used to prevent removal of hexagonal drive bits having recesses in a shank portion thereof.
Figure 25:
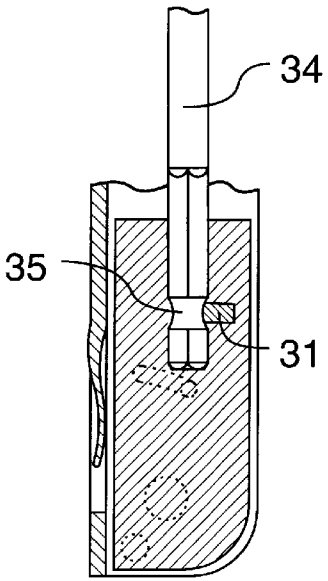
FIG. 25 is a side cross-section showing the locking bar installed.
Figure 24:
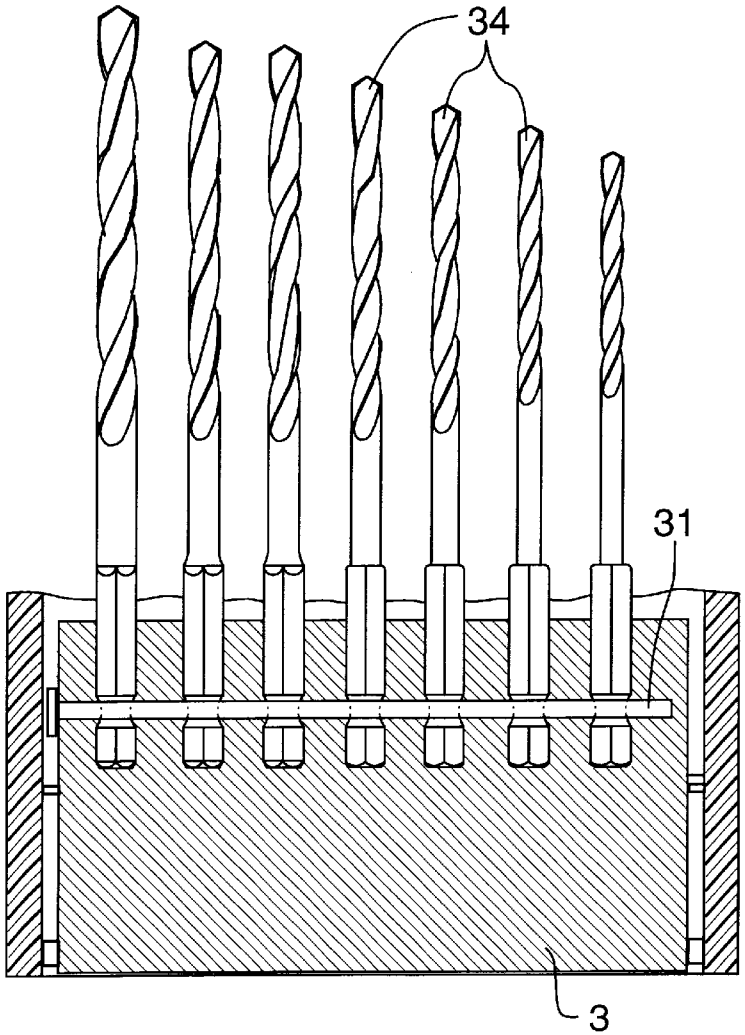
FIG. 24 is a frontal cross-section showing the locking bar installed.

FIGS. 23–25 illustrate yet another possible feature. For cases intended for hexagonal drive bits 34 having recesses 35 in a shank portion thereof, the case may have a locking bar 31 insertable into a slot 32, to fit into the recesses 35, as seen best in FIGS. 24 and 25, to prevent removal of the drill bits at the point of sale. The locking bar has a head 33 so that it may be grasped for removal by the purchaser.

Figure 26:
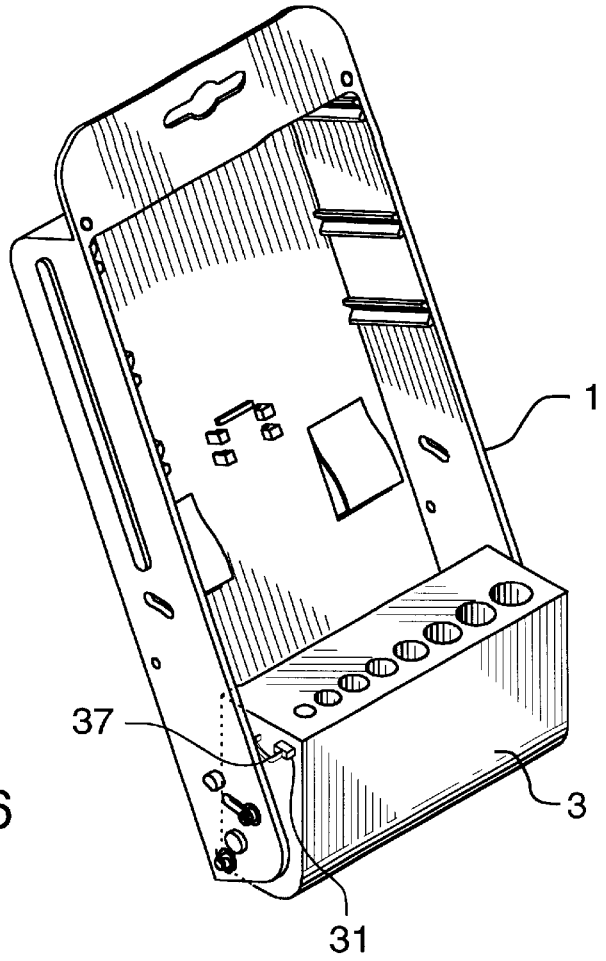
FIG. 26 is a perspective view of a case with another version of a locking bar.
Figure 27:
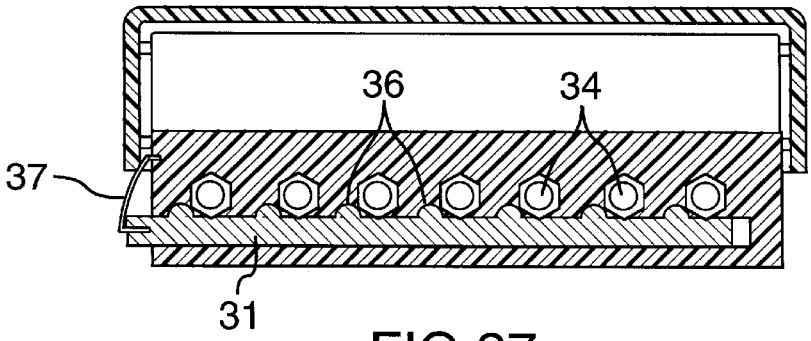
FIG. 27 is a top cross-sectional view showing the locking bar with the cover open and removal of drill bits permitted.
Figure 28:
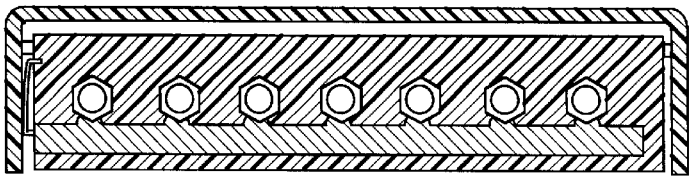
FIG. 28 is a top cross-sectional view showing the locking bar with the cover closed and removal of drill bits prevented.

FIGS. 26–28 illustrate a variation on this feature, in which the locking bar 31 remains within the slot, and is biased by a spring 37 towards the position shown in FIG. 27, where projections 36 do not interfere with the drill bits to prevent their removal. When the cover is closed, however, as shown in FIG. 28, the locking bar is forced into a position where the projections 36 are within the recesses 35 of the drill bits, thereby preventing their removal.

As a very similar alternative to that arrangement, the cover could include a cam portion which would contact the locking bar to progressively move it towards the locked position as the cover closes, against the force of an internally-positioned spring which would bias the locking bar towards the unlocked position.

Figure 29:
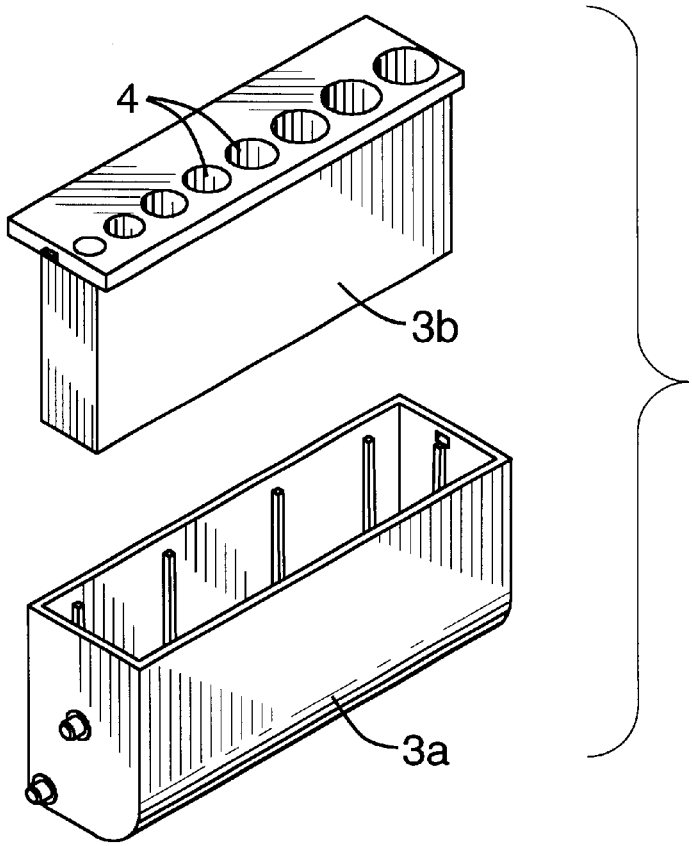
FIG. 29 is an exploded perspective of a two-piece holder, having a holder is body and an insert which could vary in its configuration.
Figure 30:
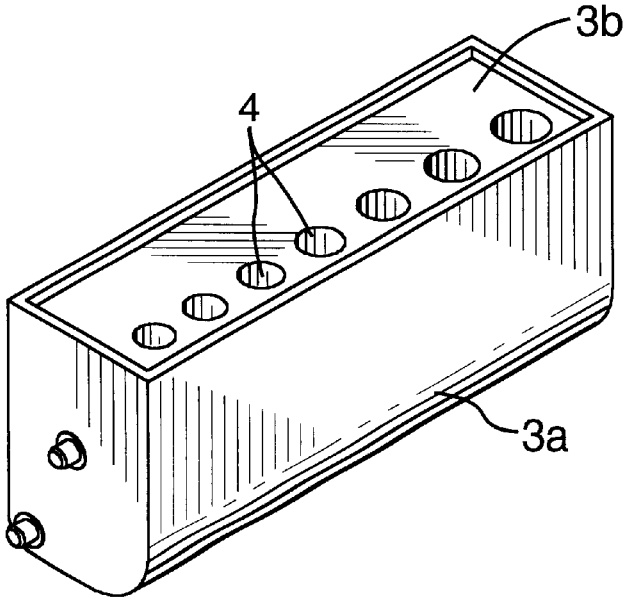
FIG. 30 is a perspective view corresponding to FIG. 29, showing the two pieces of the holder assembled.

FIGS. 29 and 30 illustrate an alternative form of holder 3 which could be used in any of the embodiments. FIG. 29 is an exploded perspective of a two-piece holder, having a holder body 3*a* and an insert 3*b* which could vary in its configuration. FIG. 30 is a perspective view corresponding to FIG. 29, showing the two pieces of the holder assembled. This configuration provides the manufacturer with many more configuration options, without dedicated molds.

It should be clearly understood that it is not intended that the invention be limited to the specific preferred embodiments described above. Thus there will be many variations which will be apparent to those who are knowledgeable in the field, and such variations are considered to be within the scope of the invention as defined by the following claims.

What is claimed as the invention is:

1. A case for drill bits and other items, comprising:

a base having at least one item holder mounted therein for movement between an access position wherein each said item holder and any items in each said item holder are angled outwardly from a main plane of said base and a storage position wherein each said item holder and any items in each said item holder are more aligned with said main plane, said item holder having a plurality of means for holding items;

biasing means biased to rotate at least one said item holder(s) towards said access position; and a cover securable onto said base, said cover arranged to contact at least one item or item holder when closing, said cover thereby rotating said item holder(s) towards said storage position;

wherein said cover is slidable along said base in a plane parallel to said base between a closed position where said item holders are covered and a position where said item holders are at least partially exposed.

2. A case as recited in claim 1, wherein said base and one said item holder are integrally formed and connected to each other by a living hinge.

3. A case as recited in claim 1, wherein said cover is rotatable relative to said base to act as a support stand for said base, said cover being first slidable to a partially open position by virtue of pins on opposing sides of one of said base and said cover, riding in corresponding slots in the other of said base and said cover, and then rotatable to a fully open position.

4. A case as recited in claim 3, wherein said base and one said item holder are integrally formed and connected to each other by a living hinge.

5. A case as recited in claim 1, wherein at least one said holder is adapted to receive hexagonal drive bits having recesses in a shank portion thereof, said case further comprising a locking bar positionable in a slot in said at least one holder so that at least portions thereof are within said recesses, thereby preventing removal of any said hexagonal drive bits positioned in said holder(s).

6. A case as recited in claim 5, wherein said locking bar is slidable between a locked position wherein projections therefrom are positioned in said recesses of any said hexagonal drive bits positioned in said item holder(s), thereby preventing removal of said bits, and an unlocked position where said projections are not in said recesses, thereby not preventing removal of said bits.

7. A case as recited in claim 6, wherein said cover upon closing thereof actuates said locking bar to move said locking bar to said locked position, said locking bar being biased to the unlocked position when said cover is not closed.

8. A case as recited in claim 7, wherein said biasing of said locking bar is by a spring adjacent said locking bar, and wherein said cover contacts said spring upon closing, to move said locking bar to said locked position.

9. A case as recited in claim 4, wherein said biasing means is provided by springiness of said living hinge between said base and said item holder.

10. A case as recited in claim 1, wherein said biasing means is a living spring defined by a cutout area of said base, positioned to act against a rear surface of said holder.

* * * * *